United States Patent [19]

Estebanell

[11] 4,355,439

[45] Oct. 26, 1982

[54] CLEANER-OPENER-COMBER DEVICE FOR TEXTILE FIBERS IN COMBING MACHINES

[76] Inventor: Juan B. Estebanell, Av. Dr. Fleming, 8-San Fructuoso Del Bages, Barcelona, Spain

[21] Appl. No.: 128,006

[22] Filed: Mar. 7, 1980

[30] Foreign Application Priority Data

Mar. 7, 1979 [ES] Spain ..... 241.864

[51] Int. Cl.[3] ..... D01G 15/40

[52] U.S. Cl. ..... 19/105; 19/107

[58] Field of Search ..... 19/98, 99, 105, 107

[56] References Cited

U.S. PATENT DOCUMENTS 2,949,645 8/1960 Noda ..... 19/107 X 3,512,217 5/1970 Bettoni ..... 19/107 X

FOREIGN PATENT DOCUMENTS 342962 7/1972 U.S.S.R. ..... 19/98

*Primary Examiner*—Louis Rimrodt

*Attorney, Agent, or Firm*—Blum, Kaplan, Friedman, Silberman & Beran

[57] ABSTRACT

An improved cleaner-opener-comber device for cleaning, opening and combing a fibrous web in a combing machine. The device includes a first and second taker-in mounted on the machine for rotation in a first direction and separated by a separation member. A larger diameter cylindrical drum is cooperatively disposed with respect to the first and second taker-ins for rotation in a direction opposite to the direction of rotation of the first and second takers-in. A plurality of plates having prongs slanted in the direction opposite to the direction of rotation of the cylindrical drum are selectively adjustably mounted proximate the cylindrical drum and allows the fibrous web to pass between the plates and the cylindrical drum for enhanced cleaning, opening and combing of the fibrous web.

5 Claims, 1 Drawing Figure

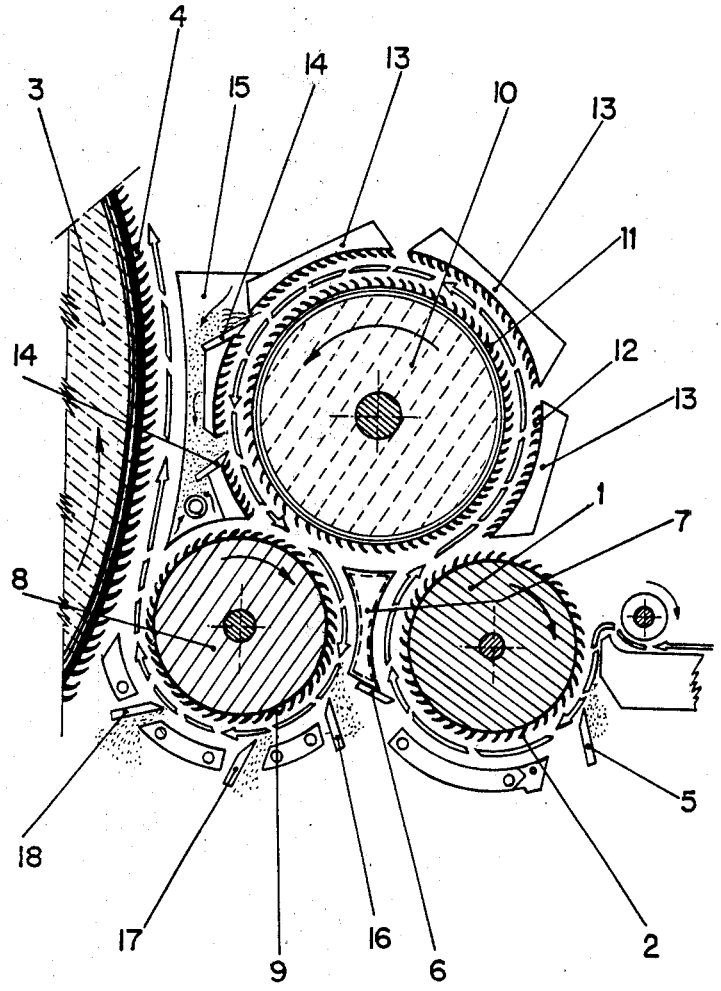
4
3
15
14
13
10
13
11
14
12
13
1
7
8
5
18
17
9
16
6
2

CLEANER-OPENER-COMBER DEVICE FOR TEXTILE FIBERS IN COMBING MACHINES

BACKGROUND OF THE INVENTION

The present invention relates to an improved cleaner-opener-comber device for all types of textile fibers, natural fibers as well as synthetic fibers, and is especially applicable to all combing machines, including combing machines, with flats, with cylinders, with cylinders and flats (mixed), with curved plates in a large drum or cylinder, etc. The present device is also applicable to all machines for opening and cleaning textile fibers.

SUMMARY OF THE INVENTION

The present invention presents the advantage that it efficiently cleans cotton, wool, restored fibers, including all types of fibers that have impurities, no matter how insignificant the impurities are, with a yield three times higher than the best combs existing on the market at the present time. The device has the power to open fiber flocks and restore thread higher than has been able to be obtained with known combs. Due to the perfect cleaning and crumbling of the fibers obtained with the device, an excellent combing which could be said to be perfect is obtained.

BRIEF DESCRIPTION OF THE DRAWING

In order to make a detailed explanation of the characteristic structure and operating of the device being the object of the invention easier, a drawing in which a practical case of realization of the invention is provided. The FIGURE is a schematic side elevational view of the present invention. It is only referred to by way of a non-limiting example of the scope of the invention.

DESCRIPTION OF THE PREFERRED EMBODIMENT

In accordance with said drawing, the cleaner-opener-comber device that is described includes a first horizontal taker-in 1 mounted on bearings on the base of the comb in the part through which the lap of fibers feed into the machine. The first taker-in 1 has a plurality of pins 2 along its periphery which are slanted in the direction in which taker-in 1 turns. This direction is opposite to the direction in which a large drum 3 or normal cylinder turns. Likewise along its periphery drum 3 has a plurality of pins 4 slanted in the direction in which it turns. The taker-in 1 in its rotation begins to convert the lap of fibers in flocks which are conveyed by taker-in 1 up to a first lower knife 5 which loosens the larger sized impurities which are eliminated by gravity or by suction from the flocks. Take-in 1 then conveys the flocks of fibers and loose fibers up to a second lower knife 6 which extracts impurities. Knife 6 is backed to a part 7 which separates between themselves taker-in 1 and a second taker-in 8 mounted like the first taker-in 1 on the base of the machine. Second taker-in 8 is also provided with a plurality of pins 9 along its periphery. Pins 9 are slanted with an orientation in the same direction in which the second taker-in turns.

The first taker-in 1 conveys the flocks of fibers and loose fibers initially divested of the larger sized impurities up to a cylinder 10 with a larger diameter mounted on the bases of the comber, also on bearings above the two twin takers-in 1 and 8. Cylinder 10 also has a plurality of pins 11 along its periphery. They are oriented in the direction in which said cylinder 10 turns, which is opposite to the direction in which the takers-in 1 and 8 turn. Cylinder 10 absorbs the flocks and loose fibers that the taker-in 1 brings to it and it makes them pass through its pins 11 and other pins 12 provided in an arched inner surface of plates 13 which surround said cylinder 10 and whose arched surface is parallel to the circumference of the cylinder in such a way that between the pins 11 and 12 the flocks are crumbled and combed. That is, the radius of curvature of plate 13 is essentially equal to the radius of curvature of cylinder 10. The impurities become loose from the fibers upon passing through knives 14. The impurities of these fibers are eventually absorbed by a suction trap 15.

The cylinder 10 moves the fibers up to a second taker-in 8 which turns at many more revolutions per time period than the cylinder 10 absorbing all the fibers and making them pass through three lower knives 16, 17 and 18 which in turn extract from said fibers the small residues of impurities. Taker-in 8 delivers the fibers already completely clean and combed to the large drum 3 which gathers them with its pins 4.

The points of contact between the turning elements, as well as the proximity of the fixed trimmed plates and of the knives can be gaged at will according to the type of work to be done.

The invention, within its essentiality, can be put into practice in other forms of realization which only differ in detail from the one indicated only as an example, which will likewise obtain the protection that is obtained. Therefore, the device of reference may be manufactured in any shape and size and with the most convenient materials and means, with a larger or smaller number of knives and fixed plates etc., since all of it remains included in the essence of the following claims.

What is claimed is:

1. A cleaner-opener-comber device for cleaning, opening and combing a fibrous wet in a combing machine having a large drum means rotatable in a first direction, comprising first taker-in means mounted in said machine for rotation in a direction opposite to said first direction and having first pin means around the periphery thereof slanted in said opposite direction for taking in said fibrous web; second taker-in means mounted intermediate said first taker-in means and said large drum means in said machine for rotation in said opposite direction and having second pin means around the periphery thereof slanted in said opposite direction for taking in said fibrous web; separation means for isolating the fibrous web portion taken in by said first taker-in means from the fibrous web portion taken in by said second taker-in means; cylindrical drum means mounted proximate said first and second taker-in means for rotation in said first direction and for cooperation with said first and second taker-in means, said cylindrical drum means having third pin means disposed around the periphery thereof and slanted in said first direction; and plate means partially surrounding said cylindrical drum means and selectively adjustable with respect thereto, said plate means having fourth pin means slanted in a direction opposite to said third pin means, said fibrous web passing from said first taker-in means to intermediate said cylindrical drum means and said plate means and then to said second taker-in means for transporting said fibrous web to said large drum means.

2. The device as claimed in claim 1, wherein said plate means includes a plurality of plates selectively adjustably spaced from said cylindrical drum means, the portions of said plates facing said cylindrical drum means being concave so that the radius of curvature thereof is essentially equal to the radius of curvature of said cylindrical drum means.

3. The device as claimed in claim 1 or 2, wherein said separation means includes a first knife means coupled thereto and extending toward said first taker-in means for extracting impurities from said fibrous web as said fibrous web is taken in by said first taker-in means.

4. The device as claimed in claim 3, wherein at least one of said plates includes a second knife means which extends toward said cylindrical drum means for further removing impurities from said fibrous web as said fibrous web travels intermediate said cylindrical drum means and said plates.

5. The device as claimed in claim 4, wherein the diameter of said cylindrical drum means is larger than the diameters of said first and second taker-in means, the diameters of said first and second taker-in means being essentially equal.

* * * * *